US007534146B2

(12) United States Patent
Chien et al.

(10) Patent No.: US 7,534,146 B2
(45) Date of Patent: May 19, 2009

(54) AUDIO JACK AND PCB ASSEMBLY HAVING THE AUDIO JACK

(75) Inventors: Min-Lung Chien, Hsin-Tien (TW); Kai-Ray Cheng, Hsin-Tien (TW); Sheng-Shun Chin, Hsin-Tien (TW)

(73) Assignee: Advanced Connectek Inc. (TW)

( * ) Notice: Subject to any disclaimer, the term of this patent is extended or adjusted under 35 U.S.C. 154(b) by 0 days.

(21) Appl. No.: 12/107,617

(22) Filed: Apr. 22, 2008

(65) Prior Publication Data

US 2008/0268703 A1 Oct. 30, 2008

(30) Foreign Application Priority Data

Apr. 27, 2007 (TW) ..... 96206791 U

(51) Int. Cl.
*H01R 24/04* (2006.01)

(52) U.S. Cl. ..... 439/668; 439/79

(58) Field of Classification Search ..... 439/668, 439/669, 79, 80
See application file for complete search history.

(56) References Cited

U.S. PATENT DOCUMENTS 4,695,116 A * 9/1987 Bailey et al. ..... 439/188
5,897,384 A * 4/1999 Hosler, Sr. ..... 439/63
6,254,399 B1 * 7/2001 Huang ..... 439/63
6,364,717 B1 * 4/2002 Lin ..... 439/668
6,368,156 B1 4/2002 Lin
6,790,047 B2 * 9/2004 Togashi ..... 439/63
6,887,111 B2 * 5/2005 Nakai et al. ..... 439/669
7,033,226 B1 * 4/2006 Chien et al. ..... 439/668
7,238,059 B1 * 7/2007 Wu ..... 439/668
7,387,543 B1 * 6/2008 Wu et al. ..... 439/668
7,458,826 B1 * 12/2008 Maatta ..... 439/79
2002/0052148 A1 * 5/2002 Nagata ..... 439/668
2002/0193006 A1 * 12/2002 Ma et al. ..... 439/669
2003/0171014 A1 * 9/2003 Lin ..... 439/79
2003/0186565 A1 * 10/2003 Kerekes et al. ..... 439/63
2003/0207600 A1 * 11/2003 Ho ..... 439/79
2004/0121625 A1 * 6/2004 Togashi ..... 439/63
2004/0242076 A1 * 12/2004 Nakai et al. ..... 439/668
2005/0215083 A1 * 9/2005 Kerekes et al. ..... 439/63
2006/0258180 A1 * 11/2006 Kerekes et al. ..... 439/63
2007/0232149 A1 * 10/2007 Tai ..... 439/668
2008/0102654 A1 * 5/2008 Kari ..... 439/63

* cited by examiner

*Primary Examiner*—Neil Abrams
*Assistant Examiner*—Harshad C Patel
(74) *Attorney, Agent, or Firm*—Hershkovitz & Associates, LLC; Abraham Hershkovitz

(57) ABSTRACT

An audio jack is embedded in an open mounting slot of a printed circuit board (PCB). The open mounting slot has two opposite inside surfaces. The audio jack has an insulative housing and two sets of terminals. The total thickness of the PCB with the audio jack embedded therein is less than a sum of the thicknesses of the PCB and the audio jack so that the PCB with the audio jack may be applied conveniently to compact electronic devices.

8 Claims, 7 Drawing Sheets

AUDIO JACK AND PCB ASSEMBLY HAVING THE AUDIO JACK

BACKGROUND OF THE INVENTION

1. Field of the Invention

The present invention relates to a jack, and more particularly to an audio jack that is mounted and embedded in a printed circuit board of an electronic device.

2. Description of Related Art

U.S. Pat. No. 6,368,156 discloses a conventional audio jack wedged between a printed circuit board (PCB) and a fixed portion of an electronic device to prevent the audio from being attached to the PCB by a soldering process that consumes time.

The audio jack has an insulative housing and a plurality of terminals. The insulative housing has a plug-insertion hole therethrough for receiving a mating plug. The terminals are mounted in the insulative housing and each terminal has a body portion and a tail portion. The body portion has a bottom. The tail portion extends downwardly and inwardly from the bottom of the body portion and has a distal end and a tab formed on the distal end for resiliently abutting against circuit traces of a printed circuit board (PCB).

However, the audio jack is mounted over the PCB so that a total thickness of the PCB with the audio jack stacked thereon being at least the sum of the thicknesses of those is too large and can not be reduced effectively to mount the PCB and the audio jack in more compact electronic device.

Furthermore, face-contact, instead of point-contact, is defined between each terminal and the PCB. Once foreign matters are accumulated between the terminal and the PCB, the face-contact fails and causes an "open circuit" between the audio and the PCB. The "open circuit" means that the terminal does not electrically contact and connect to contacts of the PCB and therefore makes current fail to flow between the audio jack and the PCB.

To overcome the shortcomings, the present invention provides an audio jack to mitigate or obviate the aforementioned problems.

SUMMARY OF THE INVENTION

The main objective of the invention is to provide an audio jack that is mounted and embedded in a printed circuit board of a communication device.

An audio jack in accordance with the present invention is embedded in an open mounting slot of a printed circuit board (PCB). The open mounting slot has two opposite inside surfaces. The audio jack has an insulative housing and two sets of terminals. The total thickness of the PCB with the audio jack embedded therein is less than a sum of the thicknesses of the PCB and the audio jack so that the PCB with the audio jack may be applied conveniently to compact electronic devices.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1 and 5-7, an assembly 3 includes, an audio jack (1) in accordance with the present invention embedded in a printed circuit board (P) (PCB) to form a PCB assembly. The PCB (P) has an open mounting slot (h) and two sets of contacts. The open mounting slot (h) is defined in the PCB (P) and has an open end and two opposite inside surfaces. The sets of the contacts are mounted on the top surface of the PCB (P) respectively adjacent to the inside surface of the open mounting slot (h).

Figure 1:
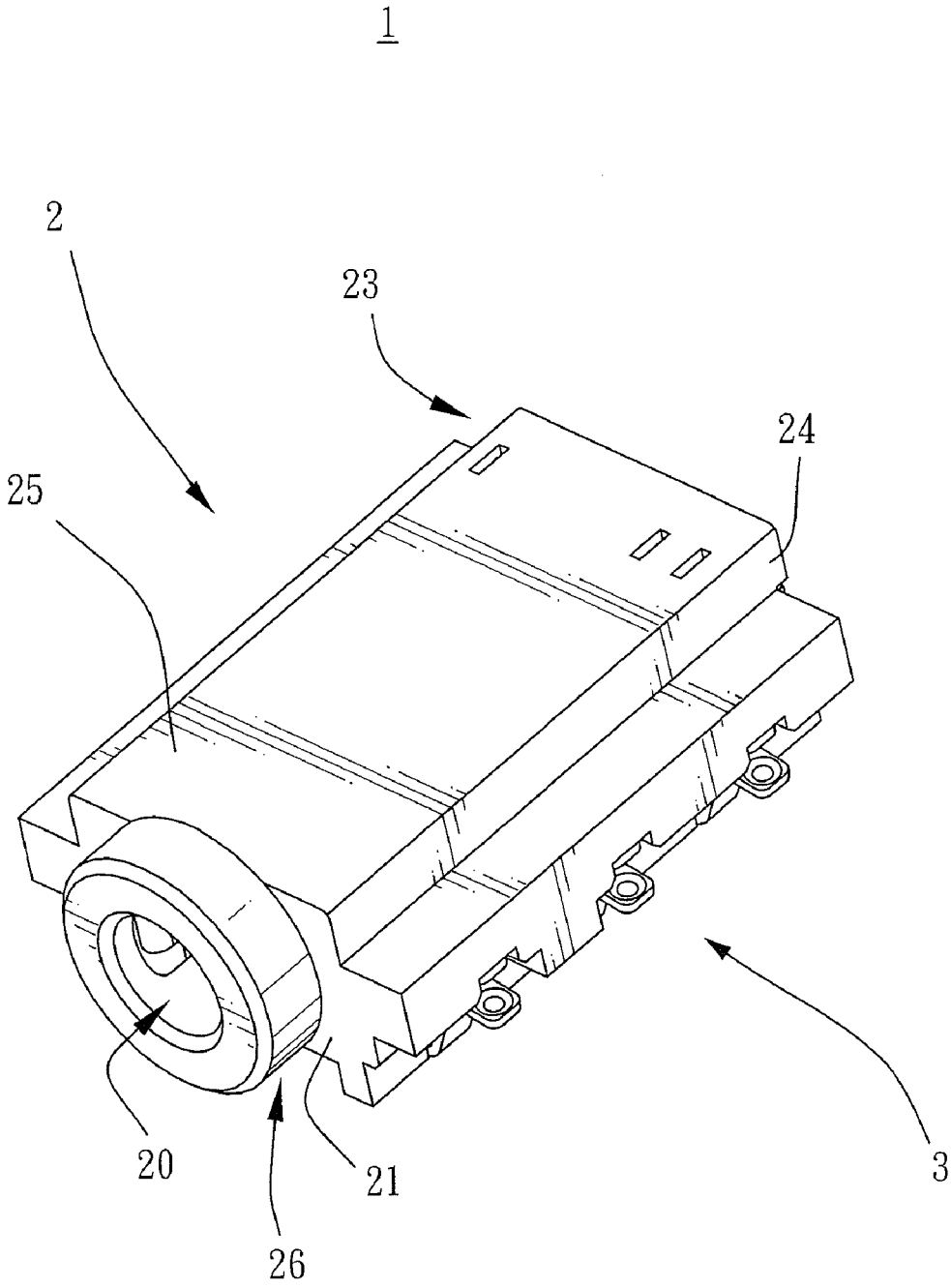
FIG. 1 is a top perspective view of an audio jack in accordance with the present invention.
Figure 2:
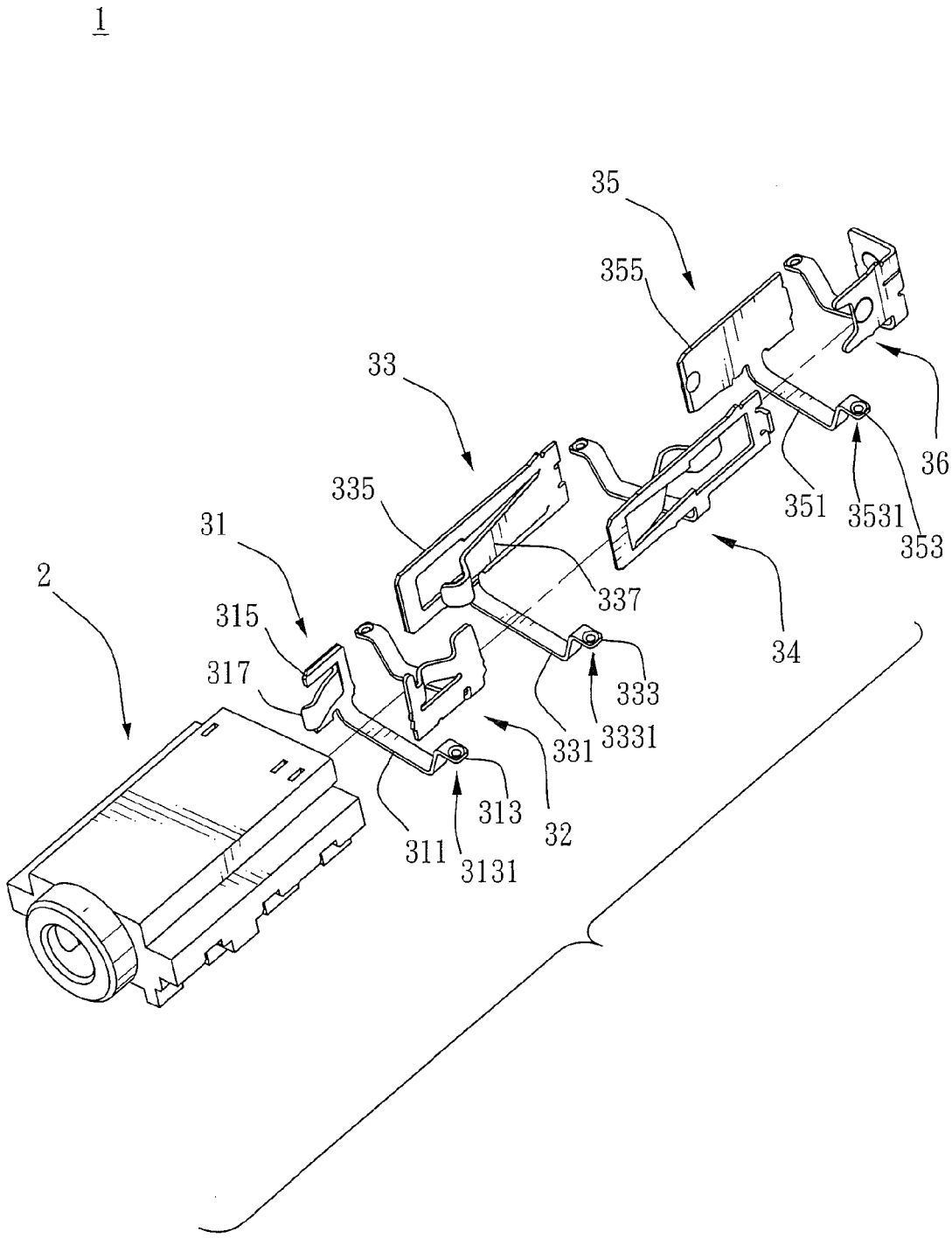
FIG. 2 is a front exploded perspective view of an audio jack in FIG. 1.
Figure 3:
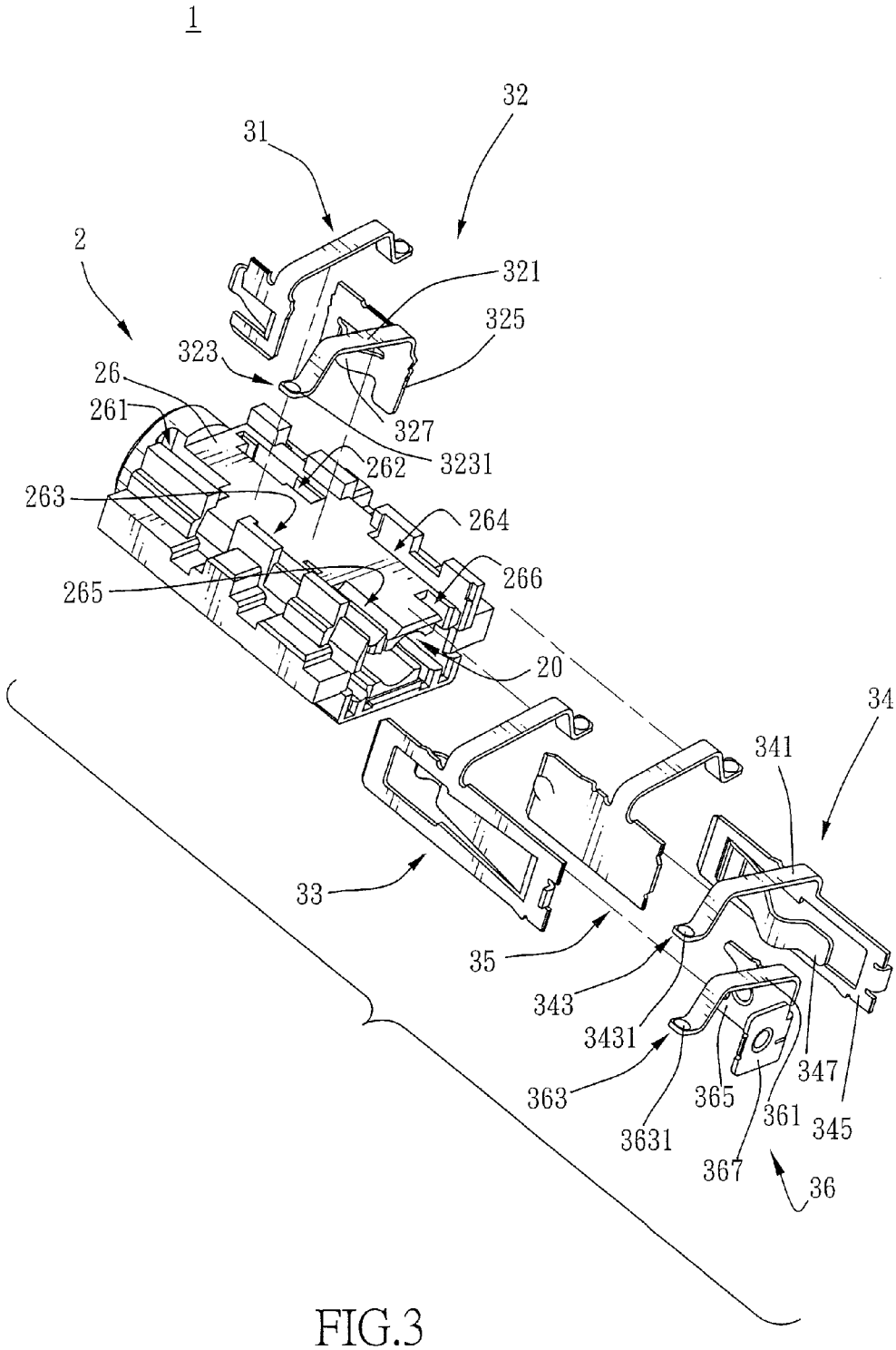
FIG. 3 is rear exploded perspective view of the audio jack in FIG. 1.
Figure 4:
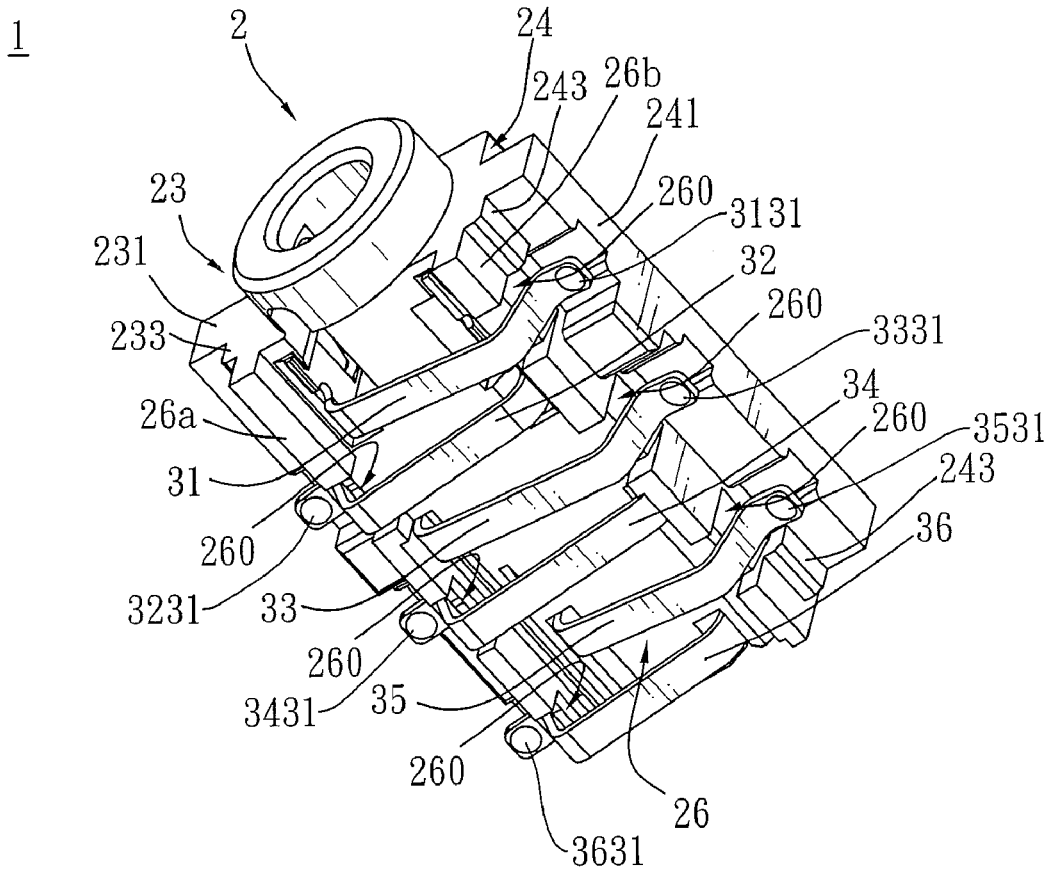
FIG. 4 is a bottom perspective view of the audio jack in FIG. 1.
Figure 5:
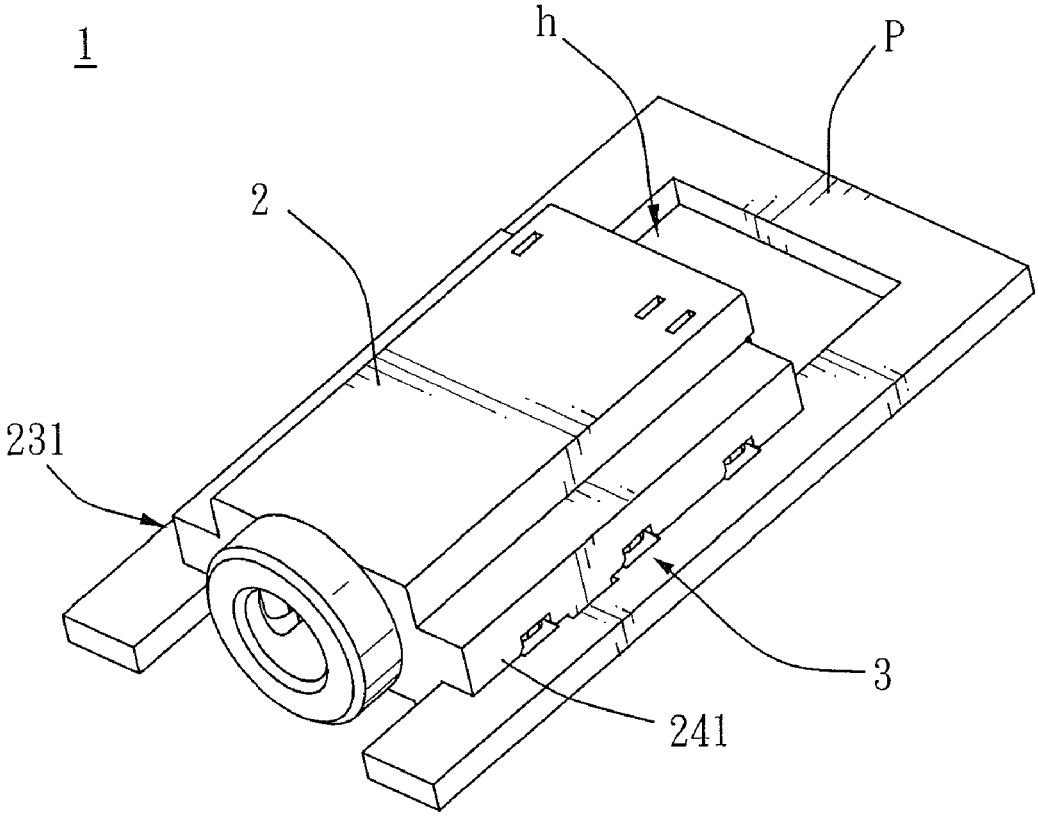
FIG. 5 is an operational perspective view of the audio jack embedded in a printed circuit board (PCB)

With further reference to FIGS. 2, 3 and 4, the audio jack (1) is mounted and embedded in the open mounting slot (h) in the PCB (P) and comprises an insulative housing (2) and two sets of terminals (31, 33, 35, 32, 34, 36).

The insulative housing (2) is mounted and embedded in the open mounting slot (h) in the PCB (P) by longitudinally sliding the insulative housing (2) through the open end or transversely pressing the insulative housing (2) into the open mounting slot (h). The insulative housing (2) has a front end (21), a rear end, two opposite sides (23, 24), a top (25), a bottom (26), a socket hole (20), two opposite longitudinal protrusions (231, 241) and two opposite longitudinal shoulders and may further have two opposite positioning walls (26*a*, 26*b*) and two sets of mounting recesses (261, 263, 265, 262, 264, 266).

The socket hole (20) is defined longitudinally through the insulative housing (2) and may receive and hold a plug of an audio cable and has a front open end and a rear open end.

Figure 6:
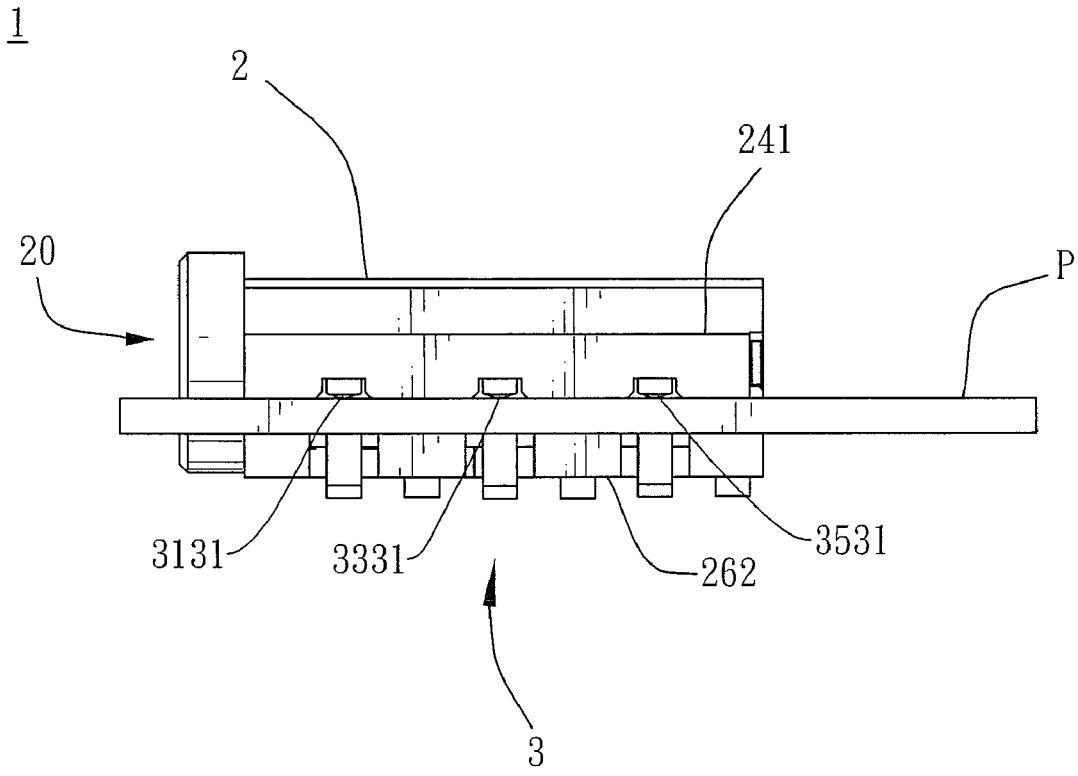
FIG. 6 is a side view of the audio jack in FIG. 5 with the PCB.

With further reference to FIG. 6, the longitudinal protrusions (231, 241) are formed respectively on and protrude transversely outward from the sides (23, 24) and each longitudinal protrusion (231, 241) has a bottom surface. When the audio jack (1) is mounted in the open mounting slot (h) in the PCB (P), the bottom surfaces of the longitudinal protrusions (231, 241) abut against the top surface of the PCB (P).

Figure 7:
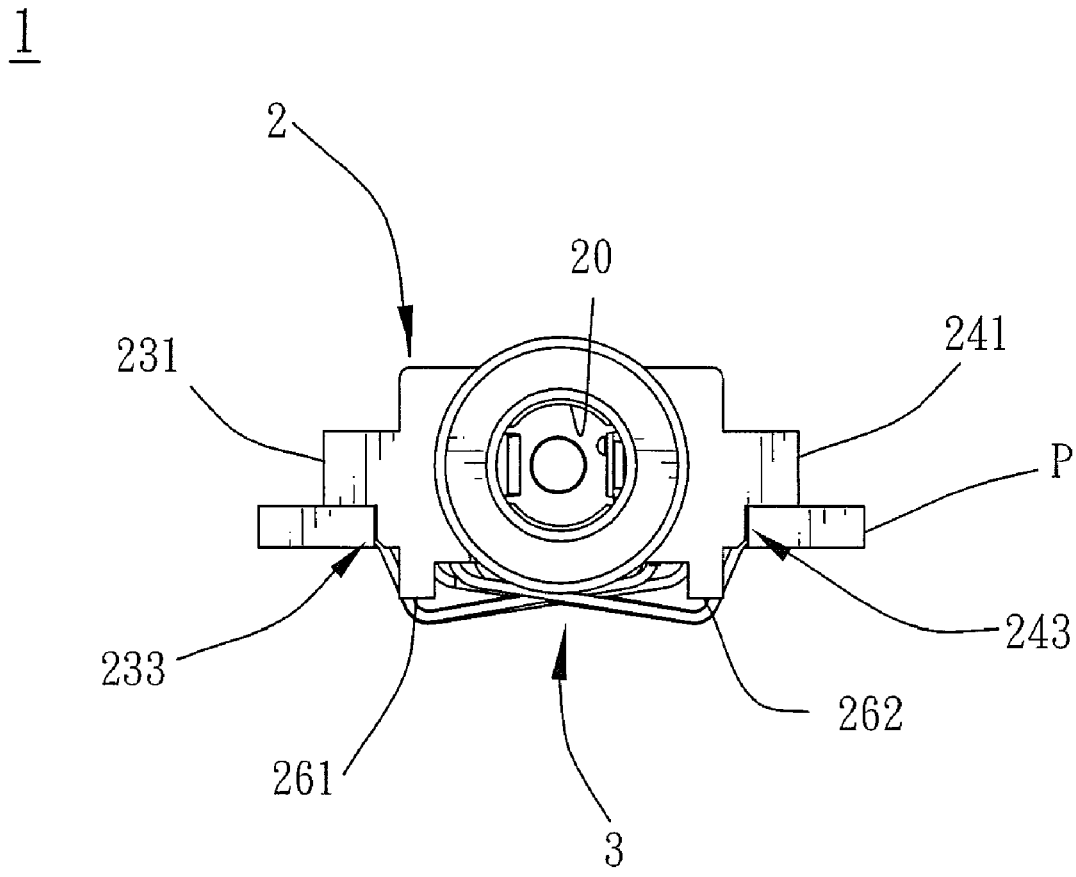
FIG. 7 is a front view of the audio jack in FIG. 6 with the PCB.

With further reference to FIG. 7, the longitudinal shoulders are formed respectively on and protrude perpendicularly downward from the bottom surfaces of the longitudinal protrusions (231, 241). Each longitudinal shoulder may have two abutment elements (233, 243) formed on the bottom surface of one longitudinal protrusion (231, 241) respectively adjacent to the front end (21) and the rear end of the insulative housing (2). When the audio jack (1) is mounted in the open mounting slot (h) of the PCB (P), the longitudinal shoulders respectively abut against the inside surfaces of the open mounting slot (h).

The longitudinal feet (26*a*, 26*b*) are formed on and protrude perpendicularly from the bottom of the insulative housing (2) and are located respectively adjacent to the longitudinal shoulders. Each longitudinal foot (26*a*, 26*b*) has a set of positioning notches (260). The positioning notches (260) are defined in the longitudinal foot (26*a*, 26*b*) at intervals. A number of the positioning notches (260) may be three.

The sets of mounting recesses (261, 263, 265, 262, 264, 266) are defined oppositely and longitudinally in the bottom of the insulative housing (2) and are located respectively near the sides (23, 24) and between the longitudinal feet (26*a*, 26*b*). A number of the mounting recesses (261, 263, 265, 262, 264, 266) of each set may be three.

The sets of the terminals (31, 33, 35, 32, 34, 36) are mounted in the insulative housing (2), correspond respectively to and are located respectively near the sides (23, 24) and may correspond respectively to and are mounted respectively in the sets of the mounting recesses (261, 263, 265, 262, 264, 266). Each terminal (31, 33, 35, 32, 34, 36) of each set has a mounting portion (315, 335, 355, 325, 345, 365), a body portion (311, 331, 351, 321, 341, 361) and a PCB-contacting portion (313, 333, 353, 323, 343, 363). Preferably, the number of the terminals (31, 33, 35, 32, 34, 36) may be six and the terminals (31, 33, 35, 32, 34, 36) may be a first terminal (31), a second terminal (32), a third terminal (33), a fourth terminal (34), a fifth terminal (35) and a sixth terminal (36).

The mounting portion (315, 335, 355, 325, 345, 365) is mounted in a corresponding mounting recesses (261, 263, 265, 262, 264, 266). Preferably, the mounting portion (315) of the first terminal (31) is C-shaped. The mounting portion (325) of the second terminal (32) is U-shaped. The mounting portions (335, 345) of the third and fourth terminals (33, 34) are rectangular.

The body portion (311, 331, 351, 321, 341, 361) is longitudinal and resilient, is formed on and protrudes from the mounting portion (315, 335, 355, 325, 345, 365) near a corresponding side (23, 24) of the insulative housing (2), extends through one of the positioning notches (26) of the set that is near the other side (23, 24) of the insulative housing (2). The body portion (311, 331, 351, 321, 341, 361) has a bent distal section formed on the body portion (311, 331, 351, 321, 341, 361) and extends through the positioning notches (26) near the other side (23, 24) of the insulative housing (2) and forms an obtuse angle between the distal section and the body portion (311, 331, 351, 321, 341, 361).

The PCB-contacting portion (313, 333, 353, 323, 343, 363) is formed on and protrudes substantially perpendicularly from the distal section of the body portion (311, 331, 351, 321, 341, 361), selectively abuts one longitudinal protrusion (231, 241) of the insulative housing (2) and may abut against one contact of the PCB (h). The PCB-contacting portion (313, 333, 353, 323, 343, 363) has a convex portion (3131, 3331, 3531, 3231, 3431, 3631). When the audio jack (1) is mounted in the open mounting slot (h) of the PCB (P), the PCB-contacting portion (313, 333, 353, 323, 343, 363) is mounted tightly between the top surface of the PCB (P) and one longitudinal protrusion (231, 241) of the insulative housing (2). The convex portion (3131, 3331, 3531, 3231, 3431, 3631) is formed on and protrudes from the PCB-contacting portion (313, 333, 353, 323, 343, 363) by a stamping process and faces outwards from the bottom of the insulative housing (2). When the audio jack (1) is mounted on the PCB (P), the convex portion (3131, 3331, 3531, 3231, 3431, 3631) abuts tightly against and electrically contacts one contact of the PCB (P) to form a point-contact therebetween instead of face-contact.

Preferably, each of the first, second, third and fourth terminals (31, 32, 33, 34) has a plug-contacting portion (317, 327, 337, 347) being resilient and bent, formed on the mounting portion (315, 325, 335, 345) and extending transversely in the socket hole (20). The plug-contacting portion (317, 327, 337, 347) may abut against one contact of the plug of the audio cable to implement audio signal transmission.

Preferably, the sixth terminal (36) has an extension tab (367) formed on and protruding substantially perpendicularly from the mounting portion (365) and covering the rear open end of the socket hole (20) in the insulative housing (2).

Because the audio jack (1) is mounted and embedded in the open mounting slot (h) in the PCB (P) instead of being mounted over the PCB (P), a total thickness of PCB (P) with the audio jack (1) embedded therein is effectively reduced to be less than the sum of the thicknesses of those. Therefore, the audio jack (1) and the PCB (P) with the open mounting slot (h) may be applied conveniently to compact electronic devices such as portable audio players or cellular phones.

Furthermore, the convex portions (3131, 3331, 3531, 3231, 3431, 3631) of the terminals (31, 33, 35, 32, 34, 36) make electrical point-contact between the audio jack (1) and the PCB (P) instead of face-contact. Therefore, foreign matters causing inadvertent open circuit problem would be seldom accumulated between the terminals (31, 33, 35, 32, 34, 36) audio jack (1) and the contacts of the PCB (P).

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An audio jack adapted to embedded in an open mounting slot of a printed circuit board (PCB), the open mounting slot having two opposite inside surfaces, the audio jack comprising:

an insulative housing having a front end;

a rear end;

two opposite sides;

a top;

a bottom;

a socket hole defined longitudinally through the insulative housing;

two opposite longitudinal protrusions formed respectively on and protruding transversely outward from the sides and each longitudinal protrusion having a bottom surface adapted to abut against a top surface of the PCB; and two opposite longitudinal shoulders formed respectively on and protruding perpendicularly downward from the bottom surfaces of the longitudinal protrusions and adapted to respectively abut against the inside surfaces of the open mounting slot in the PCB; and two sets of terminals mounted in the insulative housing and corresponding respectively to and located respectively near the sides.

2. The audio jack as claimed in claim 1, wherein:

the insulative housing further has two opposite longitudinal feet formed on and protruding perpendicularly from the bottom of the insulative housing and located respectively adjacent to the longitudinal shoulders; and two sets of mounting recesses defined oppositely and longitudinally in the bottom of the insulative housing and are located respectively near the sides and between the longitudinal feet; and the sets of the terminals correspond respectively to and are mounted respectively in the sets of the mounting recesses.

3. The audio jack as claimed in claim 2, wherein:

each longitudinal foot has a set of positioning notches defined the longitudinal foot; and each terminal has a mounting portion mounted in a corresponding mounting recesses;

a body portion being longitudinal and resilient, formed on and protruding from the mounting portion near a corresponding side of the insulative housing, extending through one of the positioning notches near the other side of the insulative housing; and a PCB-contacting portion formed on and protruding substantially perpendicularly from the body portion, selectively abutting one longitudinal protrusion of the insulative housing and having a convex portion formed on and protruding from the PCB-contacting portion, facing outwards from the bottom of the insulative housing and adapted to abut against one contact of the PCB.

4. The audio jack as claimed in claim 3, wherein each longitudinal shoulder of the insulative housing has two abutment elements formed on the bottom surface of one longitudinal protrusion respectively adjacent to the front end and the rear end of the insulative housing.

5. A PCB assembly comprising a PCB having an open slot defined in the PCB and having two opposite inside surfaces; and an audio jack embedded in the open mounting slot in the PCB and having an insulative housing embedded in the open mounting slot and having;

a front end;

a rear end;

two opposite sides;

a top;

a bottom;

a socket hole defined longitudinally through the insulative housing;

two opposite longitudinal protrusions formed respectively on and protruding transversely outward from the sides and each longitudinal protrusion having a bottom surface abutting against a top surface of the PCB; and two opposite longitudinal shoulders formed respectively on and protruding perpendicularly downward from the bottom surfaces of the longitudinal protrusions and respectively abutting against the inside surfaces of the open mounting slot in the PCB; and two sets of terminals mounted in the insulative housing and corresponding respectively to and located respectively near the sides;

wherein a total thickness of the PCB with the audio jack embedded therein is less than a sum of the thicknesses of the PCB and the audio jack.

6. The PCB assembly as claimed in claim 5, wherein:

the insulative housing further has two opposite longitudinal feet formed on and protruding perpendicularly from the bottom of the insulative housing and located respectively adjacent to the longitudinal shoulders; and two sets of mounting recesses defined oppositely and longitudinally in the bottom of the insulative housing and are located respectively near the sides and between the longitudinal feet; and the sets of the terminals correspond respectively to and are mounted respectively in the sets of the mounting recesses.

7. The PCB assembly as claimed in claim 6, wherein:

each longitudinal foot has a set of positioning notches defined the longitudinal foot; and each terminal has a mounting portion mounted in a corresponding mounting recesses;

a body portion being longitudinal and resilient, formed on and protruding from the mounting portion near a corresponding side of the insulative housing, extending through one of the positioning notches near the other side of the insulative housing; and a PCB-contacting portion formed on and protruding substantially perpendicularly from the body portion, selectively abutting one longitudinal protrusion of the insulative housing and having a convex portion formed on and protruding from the PCB-contacting portion, facing outwards from the bottom of the insulative housing and abutting against and electrically contacting the PCB.

8. The PCB assembly as claimed in claim 7, wherein each longitudinal shoulder of the insulative housing has two abutment elements formed on the bottom surface of one longitudinal protrusion respectively adjacent to the front end and the rear end of the insulative housing.

* * * * *